US005803440A

United States Patent [19]

Wells

[11] Patent Number: 5,803,440

[45] **Date of Patent: *Sep. 8, 1998**

[54] MATTRESS INNERSPRING STRUCTURE HAVING COAXIAL COIL UNITS

[75] Inventor: Thomas J. Wells, Carthage, Mo.

[73] Assignee: L&P Property Management Company, Chicago, Ill.

[ * ] Notice: The term of this patent shall not extend beyond the expiration date of Pat. No. 5,509,642.

[21] Appl. No.: 612,490

[22] Filed: Mar. 15, 1996

Related U.S. Application Data

[63] Continuation-in-part of Ser. No. 406,694, Mar. 20, 1995, Pat. No. 5,509,642.

[51] Int. Cl.[6] ..... F16F 3/04

[52] U.S. Cl. ..... 267/92; 267/103; 248/268; 248/255; 248/727

[58] Field of Search ..... 267/92, 103, 106, 267/107, 110; 5/247, 255, 256, 257, 268, 475, 476, 717, 727, 253

[56] References Cited

U.S. PATENT DOCUMENTS

| | | | |
|---|---|---|---|
| 2,309,164 | 1/1943 | Burd | 5/248 |
| 2,567,520 | 9/1951 | McInerney | 5/248 |
| 3,541,828 | 11/1970 | Norman | 72/140 |
| 3,657,749 | 4/1972 | Norman | 5/271 |
| 3,911,511 | 10/1975 | Higgins et al. | 5/255 |
| 4,095,297 | 6/1978 | Thomas, Jr. | 5/256 |
| 4,112,726 | 9/1978 | Adams et al. | 72/137 |
| 4,358,097 | 11/1982 | Zapletal et al. | 267/101 |
| 4,488,712 | 12/1984 | Higgins | 267/91 |
| 4,619,445 | 10/1986 | Sasaki | 267/100 |
| 4,625,349 | 12/1986 | Higgins | 5/248 |
| 4,867,423 | 9/1989 | Marsh | 267/91 |
| 4,960,267 | 10/1990 | Scott | 267/91 |
| 5,052,064 | 10/1991 | Hagemeister et al. | 5/246 |
| 5,188,344 | 2/1993 | Dabney | 267/103 |
| 5,395,097 | 3/1995 | Dabney et al. | 267/103 |
| 5,509,642 | 4/1996 | Wells | 5/256 |

*Primary Examiner*—Robert J. Oberleitner
*Assistant Examiner*—Chris Schwartz
*Attorney, Agent, or Firm*—Wood, Herron & Evans, LLP

[57] ABSTRACT

An innerspring structure for a mattress comprises a plurality of outer coils extending generally parallel with each other to collectively form top and bottom face surfaces of the innerspring structure. One or more of the outer coils has an inner coil of preferably similar shape positioned generally coaxially with the respective outer coil. In one embodiment, a helical lacing wire wraps together adjacent end turns of the inner and outer coaxially aligned coils to form reinforced coil units in an area of the innerspring structure to increase the firmness of an area of the mattress utilizing the invention. Helical lacing wire connects the coils of the structure together and connects the end turns of peripheral coils to a border wire surrounding the periphery of the structures at the top and bottom face surfaces. In another embodiment of the invention, the structure comprises a row of inner coils and a row of outer coils, each formed from a single continuous piece of wire such that adjacent coils of the row are interconnected by interconnection segments. The rows of coils are positioned together so that the inner coils are coaxial with the outer coils to form reinforced coil unit.

21 Claims, 6 Drawing Sheets

MATTRESS INNERSPRING STRUCTURE HAVING COAXIAL COIL UNITS

CROSS REFERENCE TO RELATED APPLICATIONS

This application is a continuation-in-part application of parent application U.S. Ser. No. 08/406,694 entitled Mattress lnnerspring Structure Having Coaxial Coil Units, filed Mar. 20, 1995, now issued U.S. Pat. No. 5,509,642 which parent application is incorporated herein by reference in its entirety.

FIELD OF THE INVENTION

This invention relates generally to mattress innerspring structures and specifically to an innerspring structure having sections of enhanced firmness.

BACKGROUND OF THE INVENTION

Conventionally, mattress innerspring structures comprise a plurality of coil springs or coils which are positioned adjacent one another to extend between top and bottom face surfaces of a mattress. The coils are usually arranged in rows which determine the length and width of the innerspring structure. When individual coil springs or coils are used, they are held together by various means to form a unitary innerspring structure. Alternatively, a row of coils may be formed from a single continuous piece of wire wherein each of the single coils are connected in the row by interconnecting segments. The rows are then fixed together to form the innerspring structure. Examples of such spring assemblies having rows formed of a continuous piece of wire are disclosed in U.S. Pat. Nos. 4,358,097 and 4,488,712 which are commonly owned with the present application.

The coils in the innerspring structure are typically formed very similar to each other, having generally the same coil diameter and similar stiffness, as dictated by the gauge of wire used to make the coils and the number of turns or pitch of each coil. Therefore, the top surface of a typical mattress will have generally equal firmness throughout the length and width of the mattress made from such an innerspring structure.

However, it is often desirable to make certain areas on the mattress more firm than other areas of the mattress. For example, it may be desirable to firm up the center section of the mattress which receives a majority of the weight from a person lying thereon. Further, it may be desirable to make the edge of a mattress more firm or durable to withstand pressures created when a person sits on the end of their bed.

Varying the stiffness of individual coils, such as by using different wire gauges and/or different numbers of coil turns, it might be possible to change the firmness in certain areas of an innerspring. However, as may be appreciated, such an undertaking would require constant conversion of the coil forming machine, and thus would result in a substantial cost increase attributable to both labor for the machine conversion and the delay in forming the innerspring structures. Furthermore, the availability of various different wire materials and gauges for forming different coils for a single innerspring structure would have to be coordinated. Therefore, such an approach is impractical from a cost standpoint.

It is also desirable to vary the firmness in certain areas of an innerspring structure which utilizes continuous coil spring units. Such continuous coil spring products have met with considerable commercial success, primarily because considerably less material is required for the same degree of firmness in such a spring product than has been employed in spring assemblies which utilize rows of interconnected individual coil springs. However, the spring products made from these continuous coil springs have been found to be difficult or very expensive to modify in order to obtain sections of the product which are more firm than other sections of the same spring product. Varying the wire gauge or coil turns of a particular coil or coils in the product is not a practical option, because all coils are formed of a continuous piece of wire. Furthermore, breaking a particular continuous row of coils into discontinuous sections would destroy many of the benefits of the continuous coil spring product. Therefore, it is an objective of the present invention to increase the firmness in selected areas of a mattress.

It is a further objective to increase the durability of selected areas on a mattress which receive a high amount of loading during normal usage.

Accordingly, it is another objective of the invention to provide an innerspring structure which is more firm and provides greater support in certain areas thereon than in other areas.

Furthermore, it is an objective of the invention to provide such an innerspring structure at a relatively low cost and with a relatively uncomplicated design.

It is another objective of the invention to create a continuous coil spring product which is so constructed that various sections of the product have varied degrees of firmness.

It is still another objective to provide a continuous coil spring product and a method for constructing same which will not require substantial variations in the assembly process in order to form sections of the product with varying firmness.

SUMMARY OF THE INVENTION

In accordance with the above-stated objectives, an innerspring structure utilizes reinforced coil units having a coil within a coil design constructed to form coaxial coil units. The coaxial coil units are coupled together into a unitary innerspring structure by helical lacing wire.

In one embodiment, the innerspring structure comprises a plurality of individual, side-by-side coils, referred to herein as outer coils, which extend generally parallel to one another and are arranged in aligned rows. The outer coils have opposing end turns which collectively form top and bottom face surfaces of the innerspring structure. Selected rows or selected areas of the innerspring structure further comprise one or more individual inner coils which extend between the top and bottom face surfaces of the structure. The inner coils are each wound and positioned generally coaxially within a respective outer coil, such that the end turns of the inner and outer coils are adjacent each other. The inner and outer coils form generally coaxial coil units. A matrix of helical lacing wires connects the inner and outer coils together at the end turns to form a reinforced generally coaxial coil unit, having a coil within a coil. The reinforced coil units have enhanced firmness or stiffness relative to just the unitary outer coils or just the inner coils. Preferably, the inner and outer coils are just pushed or positioned together from the sides thereof to form the coaxial units. Accordingly, the terms "inner" and "outer" are used primarily for reference and do not necessarily indicate the overall orientations of the coils within the coaxial spring unit.

The lacing matrix also connects the aligned rows of coils together. The lacing matrix includes a plurality of spaced apart helical wires which extend generally parallel one another and generally perpendicular to the aligned rows. Each wire wraps together the end turns of adjacent coils such that each coil within a row is connected to an adjacent coil in that row. The rows of reinforced coil units and rows of unitary outer coils are connected together to form a unitary innerspring structure. Another helical wire is wound around the periphery of the innerspring structure to connect peripheral coils to a thick border wire for enhanced edge firmness in the innerspring structure. The rows or areas of the innerspring structure, which include the coaxial units of inner coils within outer coils, create an area on the structure having a stiffness or firmness which is higher than those areas which only utilize unitary outer coils.

In one embodiment of the invention, each coil unit within a selected row or rows of coils utilizes an inner coil within an outer coil, such that reinforced rows of coaxial coil units are produced. Alternatively, only one or a selected number of units within a particular row might be the reinforced coaxial unit having a coil within a coil design. Similarly, all of the peripheral coils coupled to the border wire might be reinforced coaxial coil units to strengthen the sides of the innerspring structure. The respective inner and outer coils of a reinforced coil unit preferably have the same pitch and the same winding direction, i.e., left hand or right hand winding. Furthermore, the coils are formed such that the end turns and intermediate turns of each of the inner and outer coils have the same diameter. As such, the inner and outer coils preferably have a similar shape and nest together to form a coil unit with a double wire thickness to provide the desired firmness in selected areas of the mattress. The coils, including any inventive coaxial coil units, are positioned together and laced together. Since the inner and outer coils are generally co-extensive in each coaxial unit, the coaxial unit has generally equal support strength or firmness along its length.

An alternative embodiment of the invention utilizes a continuous coil spring product positioned with a similar continuous coil spring product such that the two products interact and form a row of adjacent coaxial coil units which generally have an inner coil with an outer coil. Each row generally consists of a plurality adjacent coil pairs which are interconnected by a Z-shaped wire segments positioned proximate the top and bottom planes of the coil rows and staggered such that each coil is connected to an adjacent coil either proximate the top plane or the bottom plane. When individual rows of continuous coil springs are positioned adjacent each other to form an innerspring structure, the various Z-shaped interconnecting segments are aligned both in rows and in columns in the top and bottom planes of the innerspring structure.

To form the coaxial coil units of the present invention, a row of outer coils, formed from a continuous piece of wire, is positioned as a row of the innerspring structure. A row of inner coils, also formed from a continuous piece of wire, is then positioned generally parallel to the row of outer coils such that the various inner and outer coils intermesh and the respective Z-shaped interconnecting segments are aligned and generally overlapped to form the reinforced coaxial coil units of the invention. As referenced above, the designations of "inner" and "outer" are utilized for reference and do not imply that one set of coils has turns with larger diameters than another set of coils or that the inner set of coils fits completely within the outer set of coils. Preferably, the coil units in the row of outer coils have the same number of turns (pitch) and turn diameters as the coil units in the row of inner coils such that they would generally be interchangeable. To form the coaxial coil units, a row of outer coils is positioned generally parallel to a row of inner coils. The coil rows are then moved together and intermeshed to form a row of coaxial coil units in accordance with the principles of the invention, similar to the way in which individual coils might be positioned together; however, entire rows are intermeshed simultaneously.

In order to form an innerspring structure having particular areas of varying firmness, the rows of coaxial coils are positioned in the particular area of the innerspring structure. Preferably, the rows extend transversely on the innerspring structure. Additional single continuous rows of coils are then positioned on either side of the rows of coaxial units, as appropriate, to form the remainder of the innerspring structure. The Z-shaped segments of the various adjacent rows of single coils and coaxial coils which interconnected adjacent pairs of coils or pairs of coaxial coil units within each row are positioned so that they overlap. The overlapped portions or sections of the Z-shaped segments are then tied together by helical wire connectors.

A first set of helical wire connectors will be disposed within the top plane of the upper innerspring surface so as to join together overlap portions of upper Z-shaped interconnection segments. Similarly, a second set of helical wire connectors lie within the bottom plane of the innerspring surface and join together overlapped portions of lower Z-shaped interconnection segments. The length of each helical wire is approximately the same as the length of the connected rows, which preferably defines the width of the innerspring structure. In accordance with the principles of the invention, the rows might also be longitudinal rows if it is desirable to firm up various sections of the innerspring structure in the longitudinal direction as opposed to the transverse direction.

The helical wire connectors connect together overlapping Z-shaped interconnection segments of the inner and outer coils to form the coaxial coil units. The helical wires also connect together the various adjacent rows to form the innerspring structure. Once the various rows of reinforced coaxial coil units are constructed, and adjacent rows are secured together, the entire innerspring structure may be secured around its perimeter to a border wire utilizing another helical wire connector as part of the lacing matrix for the innerspring structure.

Therefore, the innerspring structure of the present invention provides the desired increased firmness and durability for selected areas of the mattress utilizing reinforced coil units having coils within coils laced by helical lacing wire. The inner and outer coils utilized to form the reinforced coil unit are preferably similar and therefore, the complexity of manufacturing the innerspring structure is not drastically increased over the process used to make a conventional innerspring structure which has the same firmness throughout. Furthermore, no special wire or coiling techniques are necessary for creating the reinforced coil units, thereby keeping manufacturing costs to a minimum. The inner and outer coils are positioned together to form the coaxial units. The present invention further presents an innerspring structure utilizing continuous coil spring units in combination with rows of coaxial coil units for varying the firmness characteristics of the innerspring while maintaining the desirable characteristics of the continuous coil spring product.

The above and other objects and advantages of the present invention shall be made apparent from the accompanying drawings and the description thereof.

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
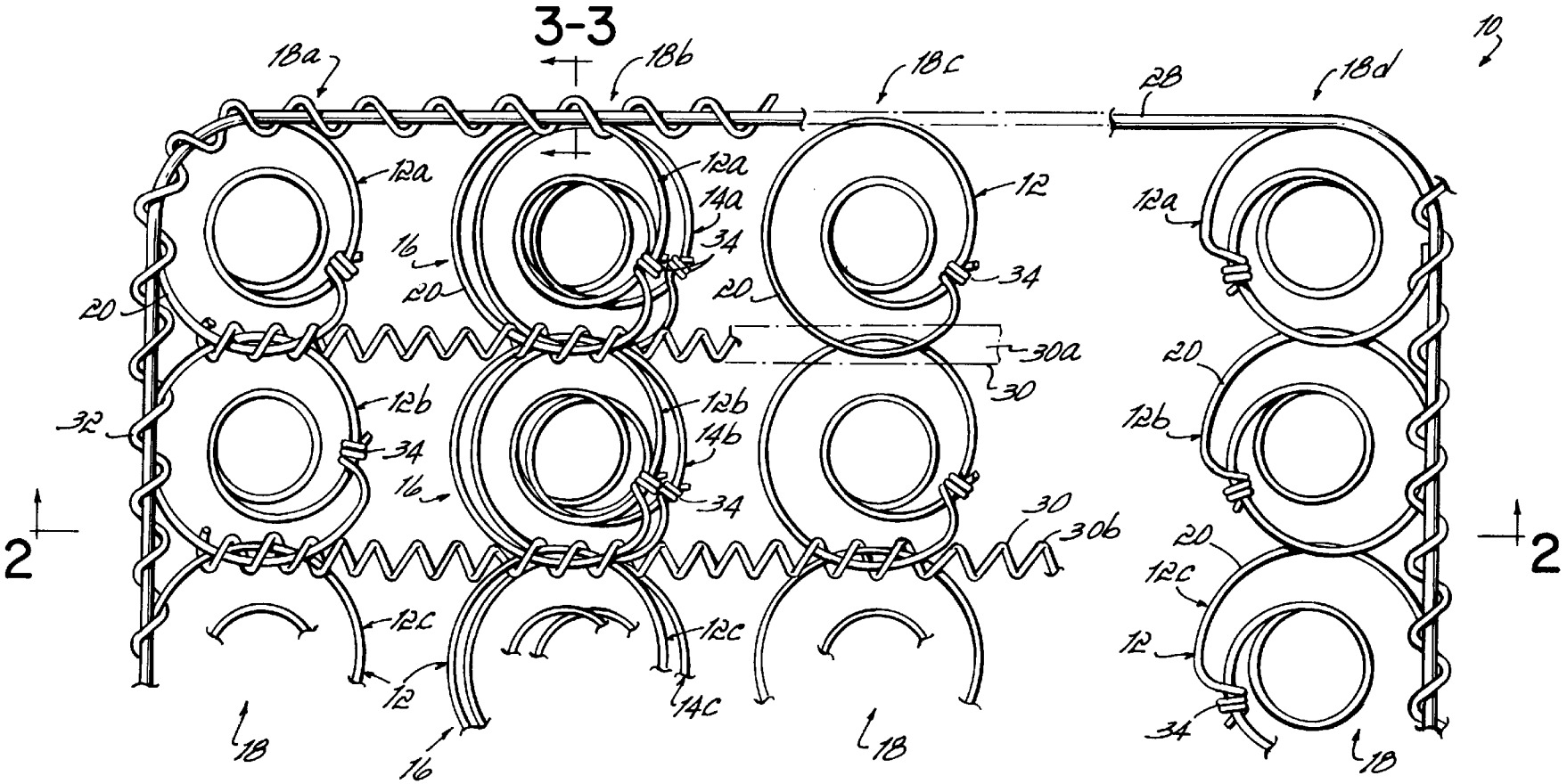
FIG. 1 is a top view of the innerspring structure of the present invention utilizing reinforced coil units laced together by a helical wire matrix.

FIG. 1 illustrates the innerspring structure 10, which utilizes the reinforced coil units of the present invention. Innerspring structure 10 includes a plurality of coils 12, which are referred to as outer coils for the purpose of this invention. Some of the outer coils 12 are utilized in conjunction with other coils 14, referred to as inner coils, which are placed within certain of the outer coils 12 to form reinforced coil units 16 as described further hereinbelow. Although, the inner coils 14 and respective outer coils 12 are preferably coaxial, each coil and its turns may vary in orientation with respect to the other. Therefore, the terms "inner" and "outer" are used primarily for reference and do not necessarily indicate the overall coil orientations within the reinforced coil unit 16.

To form the body of innerspring structure 10, the outer coils 12 are arranged side-by-side with each other and are placed in aligned rows 18. The outer coils 12 consist of a series of wire turns and each coil has opposing end turns 20, 22 (see FIG. 2). The respective end turns 20, 22 of the coils 12 collectively lie in generally the same opposing planes and define a top face surface 24 and an opposing bottom face surface 26, of the innerspring structure 10. A reinforced border wire 28, which preferably has a diameter greater than the diameter of the wires used to wind the coils 12, 14, is placed around the periphery of the innerspring structure 10 at the top face surface 24 and the bottom face surface 26. The border wire 28 provides enhanced strength at the innerspring edges.

In accordance with the principles of the present invention, certain areas of the innerspring structure 10, and specifically, certain coil rows of the innerspring structure, such as row 18*b*, are made more firm than other coil rows, such as rows 18*c* and 18*d*, by utilizing reinforced coil units 16 formed by placing an inner coil 14 within each outer coil 12 of the row. For example, the inner coil 14 and outer coil 12 might be positioned side-by-side and pushed together at their sides to form an intermeshed coil unit. Preferably, when so positioned, each inner coil 14 is wound, i.e., proceeds in a curved or winding path or direction generally similarly to its respective outer coil 14 such that the coils are generally coaxial. For example, inner coil 14*a* is wound in the same direction as outer coil 12*a*, (the right hand direction from the top face surface 24 to bottom face surface 26 in FIGS. 1 and 2). Further, inner coil 14*a* preferably has generally the same pitch (turns per unit length) as outer coil 12*a*. However, it should be understood that the inner and outer coils 14, 12 might also wind differently with different winding directions and/or pitches, although that may make them more difficult to position together into a coaxial coil unit.

Figure 2:
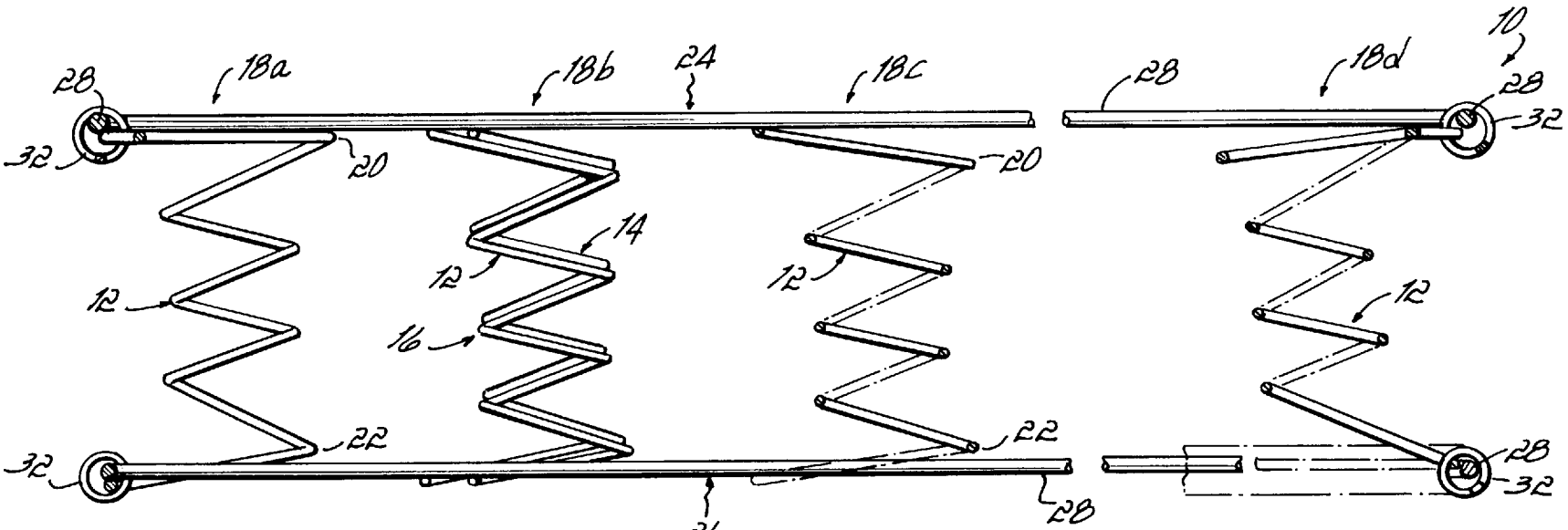
FIG. 2 is cross-sectional view taken on lines 2—2 of the innerspring structure of FIG. 1.

Each inner coil 14 is placed within an outer coil 12, and as illustrated in FIG. 2, the coil within a coil structure forms a generally coaxial, reinforced coil unit 16, which has a double wire thickness. The outer and inner coils 12, 14 are effectively nested together and extend generally coaxially one with the other such that coil turns of each coil remain generally adjacent each other in the mattress and are flexed simultaneously when a load is applied to face surfaces 24, 26 (see FIG. 2). As discussed above, the corresponding orientations of adjacent turns of the coils change with respect to each other such that one coil turn is inside of or outside of the other turn regardless of whether the coil is designated as an "inner" or "outer" coil.

The coils 12, 14 of innerspring structure 10 are held or laced together by a matrix of helical wires. More specifically, referring to FIG. 1, a plurality of spaced-apart helical wires 30 extend longitudinally in the innerspring structure 10 generally perpendicular to the aligned coil rows 18. The helical lacing wires 30 connect the adjacent coils within a row. For example, and as illustrated in FIG. 1, one helical lacing wire 30*a* would connect the first and second coils 12*a*, 12*b* within the rows, such as rows 18*a*, 18*b* and 18*c* while another helical lacing wire 30*b* would connect all of the second and third coils, 12*b*, 12*c*, respectively, in the rows 18*a*, 18*b*, 18*c*, etc. The helical wires 30 wrap the respective end turns of the adjacent coils 12, 14 proximate the face surfaces 24,26.

In addition to connecting the coils of a row together, the helical lacing wires 30 also connect the end turns of each inner coil 14 with the end turns of the respective outer coil 12, as illustrated in FIG. 1. Therefore, the helical lacing wires 30 form the reinforced coil units 16. As may be seen in row 18*b*, the top face surface end turns 20 of outer and inner coils 12*a*, 14*a* are connected together by lacing wire 30*a*. Further, the top end turns 20 of coils 12*a* and 14*a* are connected with the top face surface end turns 20 of outer and inner coils 12*b* and 14*b* by lacing wire 30*a*. Each helical wire 30 also extends generally from end to end in the innerspring structure 10 and spans between each aligned row 18 of coils and connects the rows of coils to the adjacent rows as illustrated in FIG. 1. In that way, innerspring structure 10 comprises a plurality of coils 12, 14, including reinforced coaxial coil units 16, which are connected together in rows by helical lacing wires 30. The lacing wires then connect together aligned rows 18 to form a unitary spring network for the innerspring structure 10.

Figure 3:
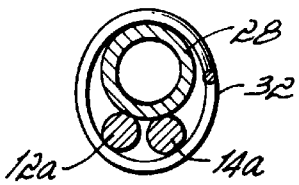
FIG. 3 is a cross-sectional view along lines 3—3 of FIG. 1 illustrating a reinforced coil unit of the invention helically laced to a border wire.

A helical wire 32 also extends around the periphery of the innerspring structure 10 with border wire 28. Helical wire 32 is wrapped to connect the border wire 28 with the top end turns 20 of each peripheral coil which is adjacent the border wire. In that way, the border wire 28 is secured into the unitary innerspring structure 10 to provide edge support for the structure. Helical wire 32 also connects the reinforced peripheral coil units 16 to border wire 28 at the ends of row 18*b*. As illustrated in FIG. 3, the border wire 28 is securely wrapped with the end turns of outer and inner coils 12*a*, 14*a* by the windings of the helical wire 32. In accordance with the principals of the present invention, row 18*b* comprises a plurality of reinforced coil units 16 such that a mattress utilizing the innerspring structure 10 will have increased firmness or stiffness proximate row 18*b*. Similarly, other rows of coils or individual coils might be formed as reinforced coil units 16, including outer and inner coils 12, 14 to selectively vary the firmness of a mattress in different areas. Still further, the coaxial coil units might be positioned around the periphery of the innerspring structure to strengthen or firm up the edge of the structure. While only the top face surface 24 of the structure 10 is illustrated in FIG. 1, the bottom face surface 26 is similarly constructed and connected together utilizing a matrix of helical wires 30 between adjacent coils and the aligned rows and utilizing a second helical wire 32, which extends around a border wire 28. The helical wire 32, along the bottom face surface 26, is shown schematically by dashed lines in FIG. 2.

As illustrated in FIG. 1, the coil end turns 20 proximate upper face surface 24 terminate by wrap sections 34, which wrap around a portion of a coil turn to form a generally continuous coil. Similar wrap sections are used proximate the bottom face surface 26. The reinforced coil units 16 of the invention which are constructed and connected by a matrix of helical lacing wires 30 provide an innerspring structure 10 with areas of reinforced firmness. The reinforced coil units 16 are preferably formed utilizing coils 12, 14 with wires having similar diameters to the wires for the remaining outer coils 12 within the innerspring structure 10. Therefore, thicker wire is not utilized to increase the firmness in areas of structure 10 resulting in material cost savings. Furthermore, the innerspring structure 10 with firm areas having reinforced coil units 16 may be constructed generally similarly to a structure which does not utilize reinforced units, thus maintaining an efficient construction process. While only one row 18 is illustrated in the figures as including reinforced coil units 16, other coil rows might utilize similar reinforced coil units.

Figure 4A:
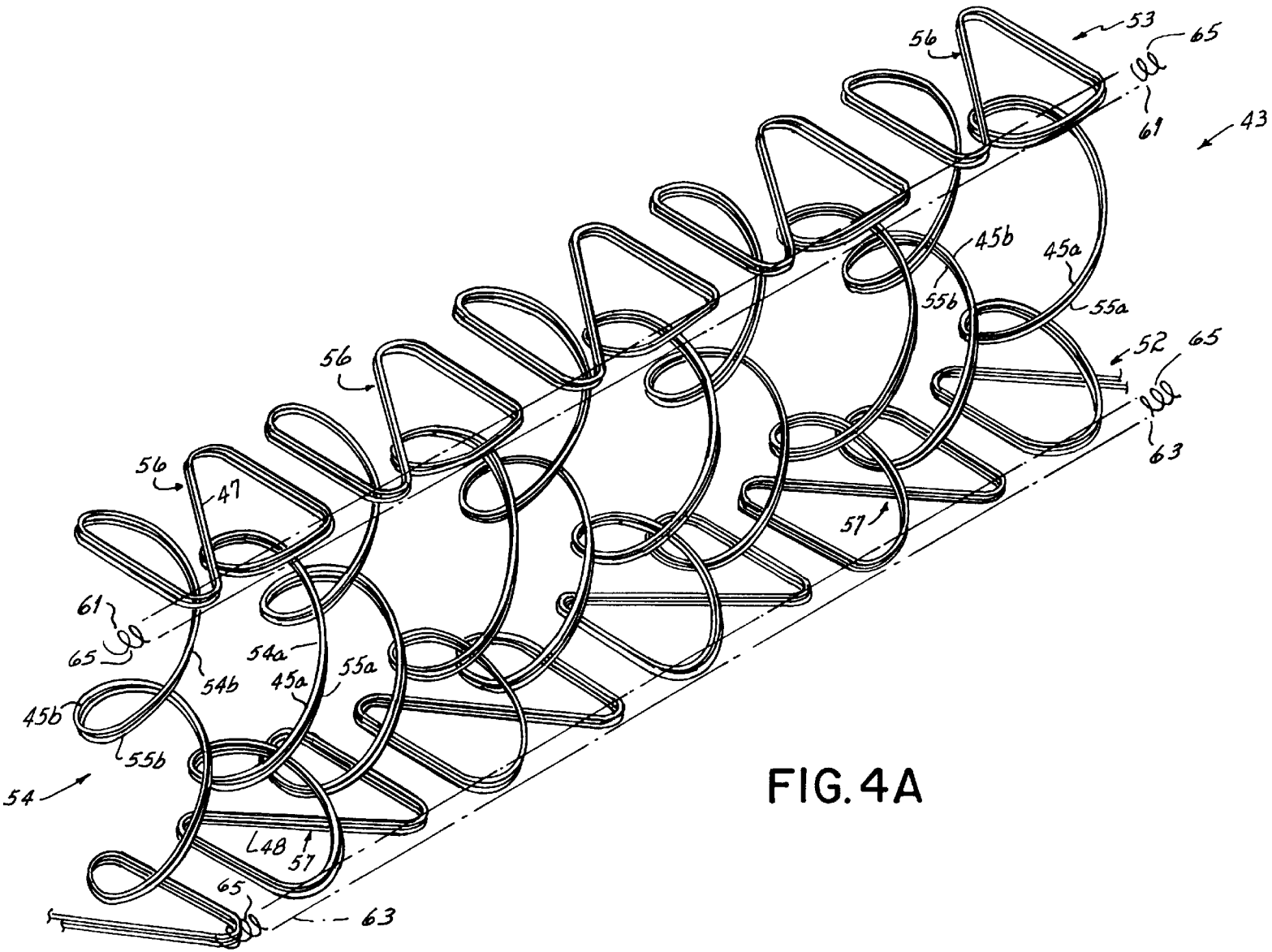
FIG. 4A is a perspective view of a continuous coil spring product having coaxial coil units in accordance with the principles of the invention.
Figure 5:
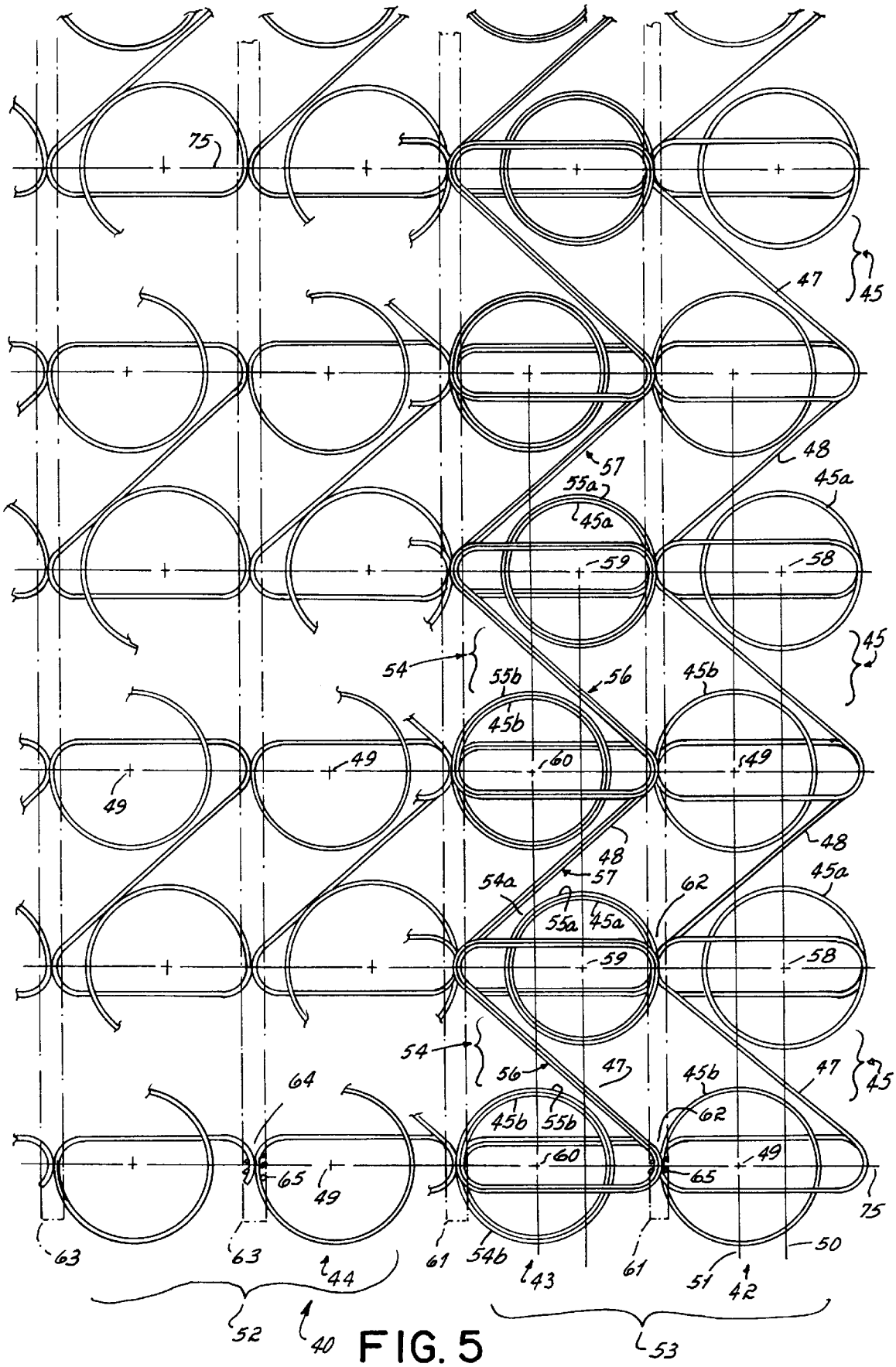
FIG. 5 is a plan view of an innerspring structure of the invention with a row of coaxial coil units.

FIG. 5 illustrates an alternative embodiment of an innerspring structure constructed in accordance with the principles of the present invention. Innerspring structure 40 includes a plurality of rows of coils, e.g., 42, 43 and 44 which extend generally parallel to each other and are adjacent to each other to form the innerspring structure 40. Each row 42, 43 and 44 of coils includes coils formed from a continuous length of wire which is generally wound to form a plurality of spaced coil pairs 45 or coaxial coil unit pairs 54. The individual coils 45*a*, 45*b* of pairs 45 are connected together by Z-shaped interconnection segments 47 and 48 which are disposed sequentially and respectively first in the upper or top plane 53 of the innerspring structure 40 and then within the lower or bottom plane 52 of the innerspring structure (see FIGS. 4A and 5). Similarly, the individual coils 54*a*, 54*b* of coaxial coil unit pairs 54 are connected together by Z-shaped interconnection segments 56, 57 which are disposed sequentially and respectively first in the top plan 53 and then in the bottom plane 52 (see FIGS. 4A and 5).

Figure 4B:
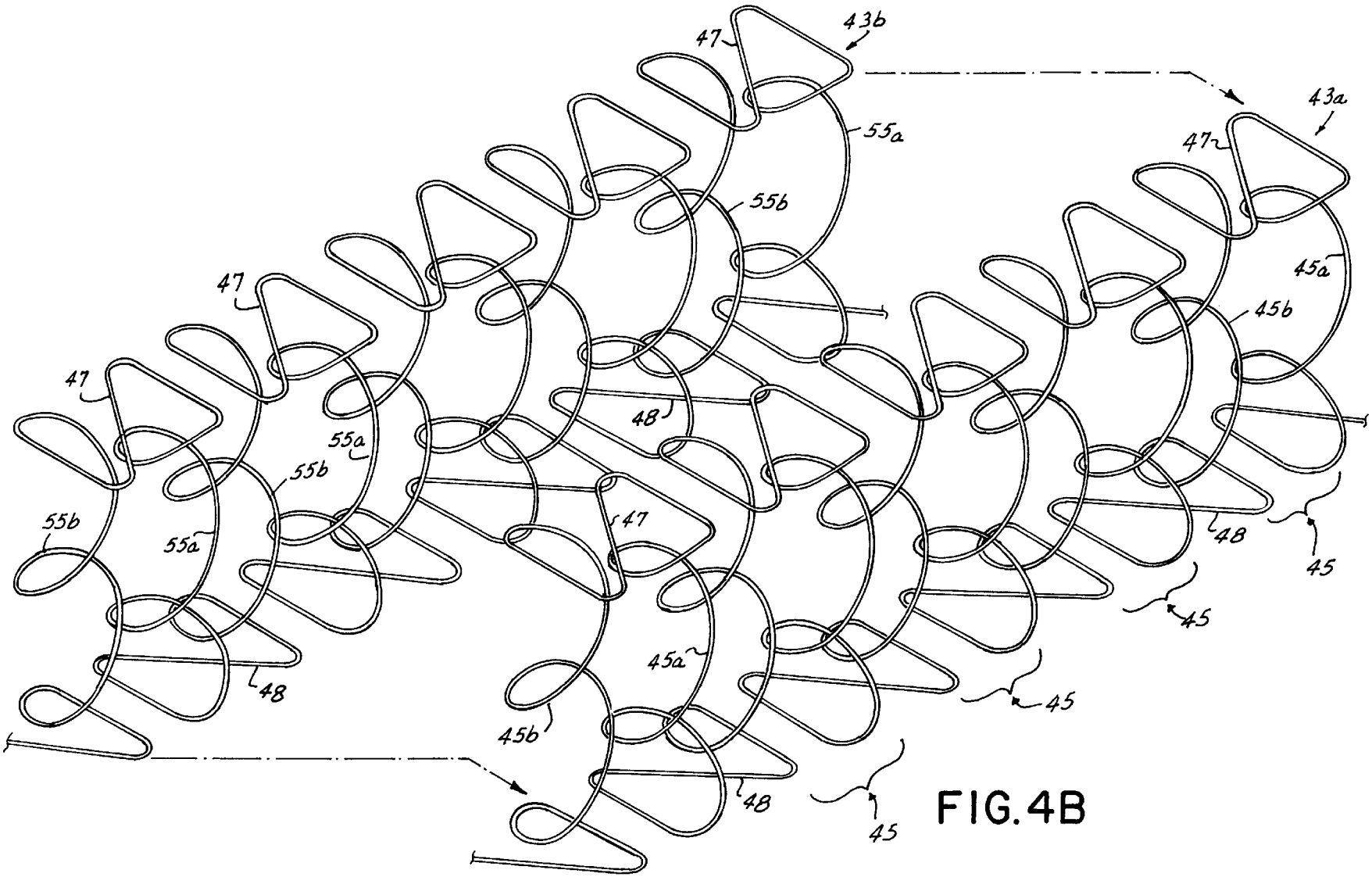
FIG. 4B is a perspective view of a continuous spring product of inner coils positioned to intermesh with a continuous spring product of outer coils to form coaxial coil units.

As best illustrated in FIGS. 4A and 4B, each coil pair 45 or coil unit pair 54 comprises a first right handed coil 45*a* or coil unit 54*a* offset from a second right handed coil 45*b* or coil unit 54*b*, preferably having the same number of turns, or the same pitch, as coil 45*a* or coil unit 54*a*. The axes 58 of the coils 45*a* of each row, such as row 42, lie within a plane 50 which is parallel to, but spaced apart from, a second plane 51 within which lie the axes 49 of the offset coils 45*b*. In a preferred embodiment, the axes 58, 49 of adjacent coils 45*a* and adjacent coils 45*b* are equidistant, with the axes being generally perpendicular to the top and bottom planes 52 and 53 of innerspring structure 40. The coaxial coil unit 54*a*, 54*b* of row 43 are similarly spaced and arranged in parallel planes wherein the axes 59, 60 are perpendicular to top and bottom planes 52, 53.

The coaxial coil units 54*a*, 54*b* of row 43 are formed in accordance with the principles of the invention by positioning together a row of inner coils, such as coils 45*a*, 45*b* and a row of outer coils designated 55*a*, 55*b* (see FIGS. 4B and 5). As discussed above, the reference to "inner" and "outer" coils is for reference purposes only. Preferably, the inner coils 45*a*, 45*b* will generally be identical to the outer coils 55*a*, 55*b* so that the two rows of inner and outer coils may be easily positioned together to form a row of coaxial coil units 54*a*, 54*b* as discussed further hereinbelow (see FIG. 4A).

Referring to FIG. 5, the innerspring structure 40 of the invention will include rows of coils 42, 43, 44, wherein at least one of the rows, e.g., 43, includes a reinforced coaxial coil unit 54*a*, 54*b* for making one or more sections of the structure 40 more firm than other sections of the structure. Generally, an entire row would be either single coils 45 or coaxial coil units 54, but half rows of coaxial units or even a single coaxial unit may be used, if desired. While FIG. 5 shows a single view for illustrative purposes, it should be understood that a plurality of adjacent rows like row 43 might be utilized. Furthermore, all of the rows, whether single coils or coaxial coil units, are preferably positioned and secured in a similar fashion.

FIG. 4A illustrates a row of coaxial coil units constructed in accordance with the principles of the present invention. Specifically, row 43 comprises a plurality of adjacent coaxial coil unit pairs 54 or coil units 54*a*, 54*b*, which are made up of inner coil pairs 45, arranged as inner coils 45*a* and 45*b*, as well as outer coil pairs 55, including individual outer coils 55*a* and 55*b*. That is, each coaxial coil unit, e.g., 54*a*, will comprise of inner coil 45*a*, and an outer coil 55*a*. As mentioned, in a preferred embodiment, the inner and outer coils 45*a*, 55*a* will generally have the same shape and will generally be interchangeable.

Referring to FIG. 4B, row 43 of reinforced coaxial coil units 54 is formed by positioning or intermeshing a row of outer coils 55*a*, 55*b*, with a row of inner coils 45*a*, 45*b*. For example, a first row 43*a* of inner coils 45*a*, 45*b* might be positioned as a row of the innerspring structure 40. Next, a row 43*b* of outer coils 55*a*, 55*b* is positioned adjacent to the row 43*a* of inner coils 45*a*, 45*b* to extend generally parallel thereto such that the inner coil pairs 45 are aligned with the outer coil pairs 55. Each row 43*a*, 43*b* is made of a continuous pieces of wire so that the adjacent coils are connected preferably by Z-shaped interconnection segments. As mentioned, the row of outer coils 55*a,* 55*b* may be formed in the same way in which the row of inner coils 45*a,* 45*b* is formed, as the designation of inner and outer coils is made for the purpose of reference to describe the unique construction of the coaxial coil units discussed hereinabove. Preferably, the rows of inner coils 45*a,* 45*b* and outer coils 55*a,* 55*b* are positioned such that all the coils have the same winding direction as well as the same orientation of the various Z-shaped interconnection wire segments 47, 48. For consistency, the interconnection segments of the row of outer coils 55*a,* 55*b* are also referenced as 47, 48. In that way, as illustrated in FIGS. 4A and 4B, when the adjacent rows 43*a,* 43*b* of coils are pushed together to form a row 43 of coaxial coil units 54 in accordance with the principles of the present invention, the individual rows 43*a,* 43*b* intermesh easily together so that at least one inner coil, e.g., 45*a,* of each reinforced coaxial coil unit 54*a* is wound or positioned coaxially with respect to an outer coil 55*a* of the coaxial coil unit. When a row 43 of coaxial coil units 54 is formed, the overlapping interconnection segments 47, 48 are collectively designated as segments 56, 57, respectively (see FIGS. 4A and 5).

As will be appreciated from the following description, the coil interconnection technique utilized to form the coils of the innerspring unit 40 prevents adjacent coils from binding when compressed even if they are not of hourglass configuration. Thus, a variety of shapes may be employed such as hourglass or potbellied, but the cylindrical shape illustrated is a preferred embodiment.

Rows of reinforced coaxial coil units 54 might be utilized at the sides of the innerspring structure 40 to extend longitudinally therein for strengthening the mattress sides, which receive a lot of pressure from persons sitting thereon. However, in a preferred embodiment, the rows 43 of coaxial coil units 54 are positioned to lie transverse in the innerspring structure 40 for forming firmer sections at positions along the length of the innerspring structure 40 and along the length of a mattress formed from such an innerspring structure.

Preferably, each innerspring row, 42, 43 and 44 would generally contain coils therein which are identical to every other coil in the row and of the same twist direction and pitch (turns per unit length). That is, each row is generally configured identical, except rows of coaxial coil units 54 will comprise two rows of inner and outer coils 45, 55 intermeshed together.

In the preferred embodiment of the invention, the spacing between the axes 59, 60 of adjacent coils within a row 43 is the same as the spacing between axes 49, 58 of adjacent coils in the other rows 42 and 44. The same positioning and spacing would also hold true for two adjacent rows of single inner coil units 45*a,* 45*b* or two adjacent rows of coaxial coil units 54. Should a coil pair 45*a,* 45*b* in row 42 be interconnected in the top plane 53 of the innerspring structure 40, the adjacent pair of coaxial coil units 54*a* and 54*b* are also interconnected in the same top plane 53. This is best illustrated in FIG. 5 wherein in row 42, typical adjacent coils 45*a,* 45*b* are interconnected by Z-shaped wire segments 47 lying within the top innerspring plane 53, and the adjacent pair of coaxial coil units 54*a,* 54*b* are interconnected by a double Z-shaped wire segment 56 also lying in the same top plane 53 of the innerspring structure 40. This pattern is generally repeated throughout the entire innerspring structure 40. Similarly, the Z-shaped segments 48 in the bottom plane 52 of the innerspring structure 40 lie in the same plane with the double Z-shaped segments 57. This pattern is also repeated throughout the innerspring structure 40. The result is that Z-shaped segments in the top plane 53 are aligned in columnar fashion and similarly the Z-shaped segments in the bottom plane 52 are also aligned in columnar fashion. In other words, the Z-shaped segments 47, 56 and 48,57 are aligned both in rows and in columns in the top and bottom planes 52, 53 of the innerspring structure 40.

Figure 7:
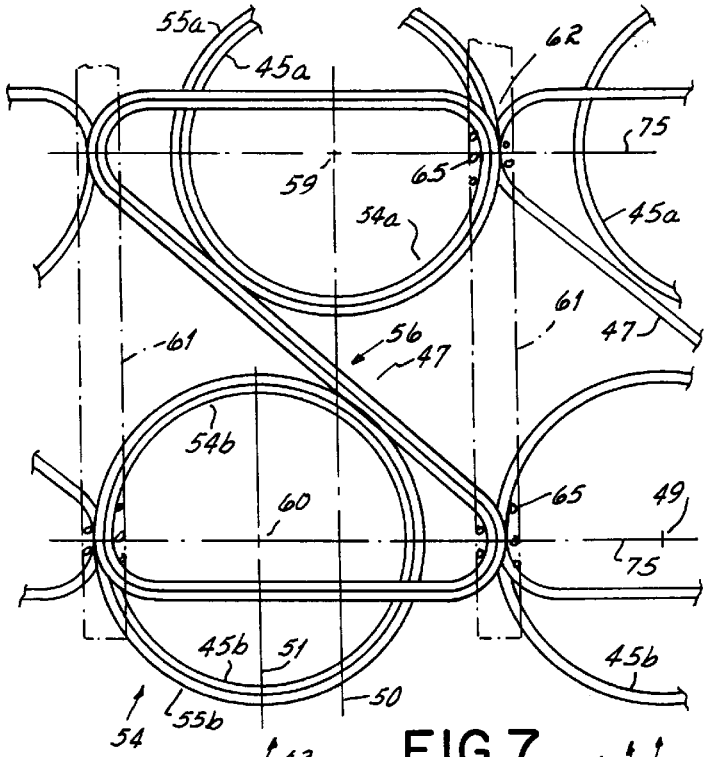
FIG. 7 is an enlarged fragmentary top plan view of a portion of the assembly shown in FIG. 6.

In order to connect the adjacent rows of coils and coil units, the rows 42, 43, 44 are first positioned so that the Z-shaped segments which interconnect adjacent pairs of coils within each row, such as segments 47, 48 for a pair of inner coils or single coils 45*a,* 45*b,* or segments 56, 57 for a pair of coaxial coil units 54*a,* 54*b,* overlap the Z-shaped segments of the adjacent row of coils or coil units. These overlapped portions or sections of the Z-shaped segments are then connected or tied together by helical wire connectors. Referring to FIGS. 4A and 5, a first set of helical wire connectors, herein designated 61, is disposed within the top plane 53 of the innerspring structure 40 so as to join together overlapped portions 62 of upper Z-shaped interconnection segments, such as interconnection segments 47 and 56 as illustrated in FIG. 7. Similarly, a second set of helical wire connectors, herein designated 63, lie within the bottom plane 52 of the innerspring structure 40 and serve to join together overlapped portions 64 of lower Z-shaped interconnection segments, such as 48 and 57. In FIG. 5, the left side illustrates the lower plane 52 of the innerspring structure to show the connector 63 and Z-shaped segments 48. As evident in FIG. 4A, the length of each helical wire connector is preferably approximately the same as the length of the rows, and the helical wire connectors 61, 63 extend generally parallel to the rows. As illustrated in FIG. 4A, the helical wire connectors 61, 63 also connect together the row of adjacent inner coils 45*a,* 45*b,* and the row of adjacent outer coils 55*a,* 55*b*. In that way, the inner coils 45*a,* 45*b* are maintained generally coaxial and intermeshed with the outer coils 55*a,* 55*b* to collectively form the coaxial coil units 54*a,* 54*b* of the invention.

The assembly of the helical wire connectors to the rows of continuous coils may be accomplished on an assembly machine. In such a machine, the adjacent rows of coils are positioned so that the sections 62, 64 of the adjacent Z-shaped segments 47, 56 and 48, 57, respectively, are in overlapping relationship. A helical wire is then rotated or screwed onto the overlapping sections 62, 64 of the Z-shaped segments. In forming a row of reinforced coaxial coil units 54 in accordance with the principles of the present invention, a row of inner coils 45*a,* 45*b* must be nested or positioned with a row of outer coils 55*a,* 55*b* before any helical wire connectors 61, 63 are positioned over the overlapping sections 62, 64. After completion of the threading of a particular helical wire connector onto the overlapped sections 62, 64 of the Z-shaped segments, the now connected adjacent rows of coils and/or coaxial coil units are indexed forwardly and another pair of upper and lower helical wire connectors 61, 63, are threaded over the next row of coils 45*a,* 45*b*, or the next row of coaxial coil units 54*a,* 54*b,* depending upon the construction of the next row. The process is repeated for the desired length of the mattress, row upon row, after which the spring assembly is removed from the machine.

Referring now to FIG. 7, it will be seen that the diameters of the wire making up the helical wire connectors 61, 63 are preferably approximately one-fourth (¼) the radius of the overlapped sections 62, 64 of the Z-shaped segments. This relationship of having the radius of the Z-shaped segments, over which the helical wire connector 61, 63 is threaded, approximately eight times the radius of the helical wire, has the effect of permitting several rotations 65 of the helical wire connector to pass through and lock adjacent overlapped sections together. So locked or interconnected, the adjacent coils or coaxial coil units are free to pivot relative to each other but are locked against relative longitudinal or lateral movement. In other words, this relatively small diameter helical coil, when used to lock the overlapped large radius sections 62, 64 of the segments together, permits only relative pivotal movement between the adjacent interconnected coils.

Figure 6:
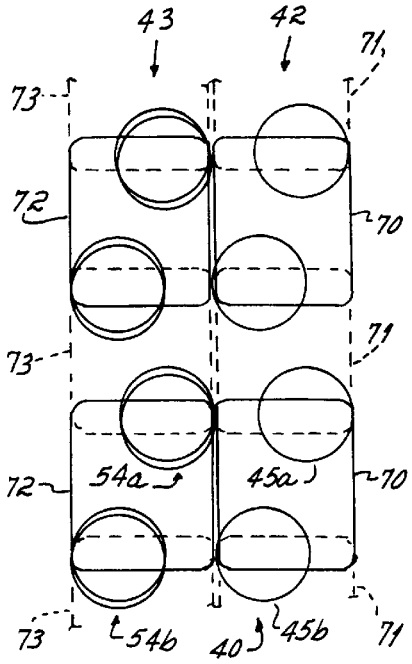
FIG. 6 is a diagrammatic plan view in which each coil pair and coaxial coil unit pair in each row is designated by block lines constituting continuations of the Z-shaped coil interconnection segments.

Referring now to FIG. 6, each block 70 represents the effective outline of a typical top plane Z-shaped interconnection segment 47 in coil row 42. Similarly, each block 72 represents the outline of a typical top plane Z-shaped interconnection segment 56 in row 43 containing the coaxial coil units 54*a*, 54*b* of the invention. Each block 71 represents the outline of a typical bottom plane Z-shaped interconnection segment 48 in coil row 42 and each block 73 represents the outline of a typical bottom plane Z-shaped interconnection segment 57 in coil row 43. Thus, as apparent from the diagram in FIG. 6, the blocks 70, 72 and 71, 73 representing load supporting units. Each of these units 70, 72 and 71, 73 are overlapped such that the effect of the construction of the innerspring structure 40 is a very densely packed innerspring assembly with a relatively high count of coils. Furthermore, coil row 43 provides load bearing units which are firmer, stronger and more supportive according to the description of the invention.

Referring now to FIGS. 5 and 7, it will be noted that the several rotations 65 of the helical wire connectors 61, 63 which pass around and lock adjacent overlapped coil segments 62, 64 are all centered in a common transverse plane 75. It will be further noted that this plane 75 passes through the vertical axes 58, 59 or 49, 60 of all of the coils or coaxial coil units contained in a transverse column. Consequently, each coil or coil unit of a row is connected to two coils or coaxial coil units of the adjacent rows by several rotations 65 of the helical connectors 61, 63 the center planes 75 which are located in a diametrical plane defined by the vertical axes 58, 59 or 49, 60 of the coils or coil units. This location of the axes of the coils or coil units relative to the location and shape of the overlapped and connected segments 62, 64 has been found to prevent lateral deflection or distortion of the coils when the coils are fully compressed.

Once the various rows and coils are assembled into the innerspring structure 40 of the invention, a border wire, like that shown in FIGS. 1–3, might be utilized to finish the structure. To that end, the border wire is secured to the outer peripheral coils of the adjacent rows, such as by a helical coil 32. Other connecting mechanisms for fixing the border wire to the innerspring structure 40 might also be utilized.

Figure 8:
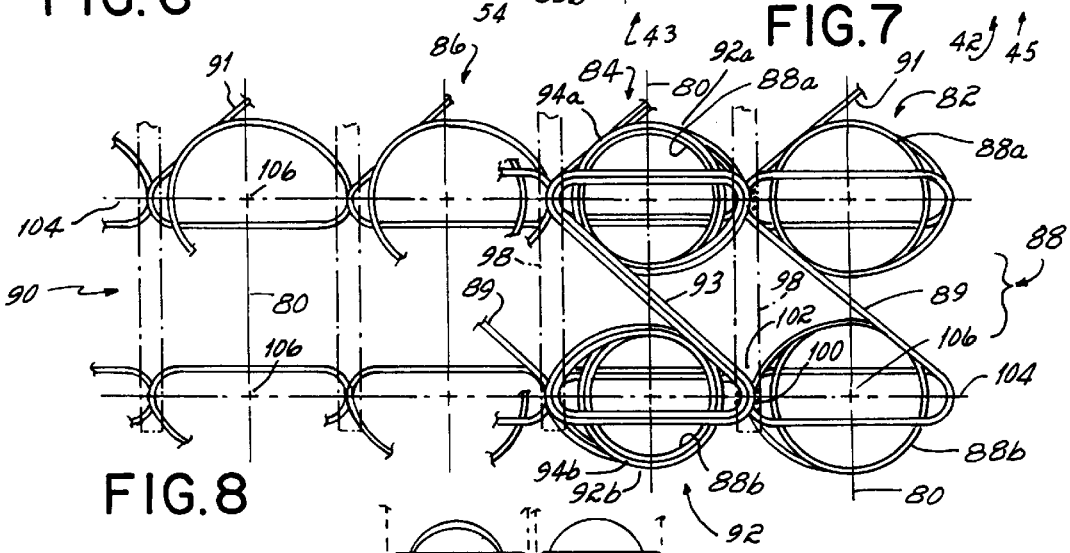
FIG. 8 is a top plan view, partially broken away of an alternative embodiment of an innerspring structure of the invention.
Figure 9:
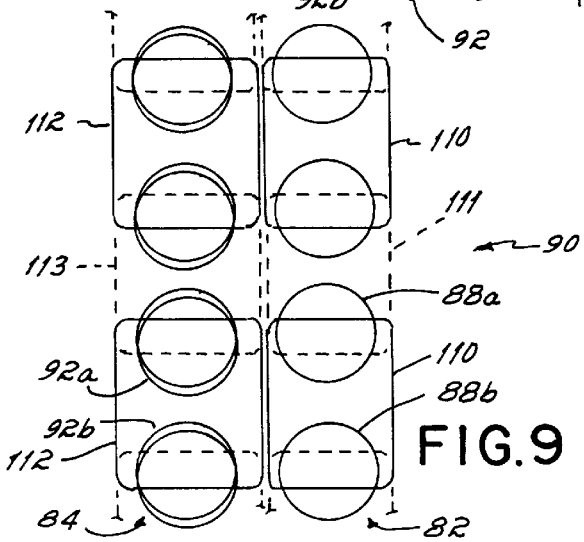
FIG. 9 is a diagrammatic plan view of the embodiment of FIG. 8 in which each coil pair and coaxial coil unit pair in each row is designated by block lines constituting continuations of the Z-shaped coil interconnection segments.

FIGS. 8 and 9 illustrate another embodiment of the invention in the application made with a continuous coil spring product similar to those illustrated in FIGS. 4A–7. The construction is illustrated diagrammatically on the top plan view of FIG. 8. In general, the spring assembly of FIGS. 8 and 9 is identical to the spring assembly of FIGS. 4A–7, except that the coils are positioned with the interconnecting Z-shaped segments such that the vertical axes of all of the coils of a single row are located in the same vertical plane 80, rather than alternatively staggered in two different planes as shown in FIGS. 4A–7.

The Z-shaped segments, rather than extending outwardly from one side only of each coil extend outwardly beyond both sides of each coil so that this construction has the same advantages of the embodiments of the FIGS. 4A–7, and it minimizes or eliminates any tendency of the coils to overlap or contact adjacent convolutions of the same coil. Specifically, in this embodiment each row of coils 82, 84, 86 is formed from a continuous length of wire and each wire forms a plurality of spaced coil pairs 88 interconnected by substantially Z-shaped wire segments 89 disposed in the top plane of the innerspring structure 90. In the bottom planes, substantially Z-shaped wire segments 91 interconnect adjacent coil pairs 88 of the innerspring structure 90.

In accordance with the principles of the present invention, each innerspring 90 will preferably contain at least one row 84 of coaxial coil pairs 92. Each pair 92 of coils 92*a*, 92*b* will comprise a pair of inner coils 88*a*, 88*b*, and a pair of outer coils 94*a*, 94*b* which are preferably positioned and intermeshed together by the method described hereinabove with respect to FIGS. 4A–7. That is, rows of inner coils 88*a*, 88*b* are pushed together with rows of outer coils 94*a*, 94*b* to form coaxial coil units in accordance with the present invention which are collectively referred to as coil units 92*a*, 92*b*. That is, for example, coil unit 92*a* will include an inner coil 88*a*, and an outer coil 94*a* and each coil unit 92*b* will include an inner coil 88*b* and an outer coil 94*b*. The coil units 92*a*, 92*b* are connected by Z-shaped interconnected segments 93, 95 in the top and bottom planes, respectively.

Each coil pair 88, 92 comprises a first right handed coil 88*a* or coil unit 92*a* offset from a second right hand coil 88*b* or coil unit 92*b* preferably having the same number of turns as coil 88*a* or coil unit 92*a*, respectively. However, the axes of coils 88*a*, 88*b* and coil units 92*a*, 92*b* lie within the same plane 80 containing the axes of the adjacent coils and coil units. While preferably, the coils of each row generally have the same diameter twist direction and pitch, alternative twist directions diameters or pitches may still be utilized in practicing the present invention.

In the embodiment of FIGS. 8 and 9, the corners of the interconnecting Z-shaped segments are both located outwardly from the circumference of the coils 88 and coils units 92 in both the top and bottom planes of the innerspring structure 90. The outward spacing of the Z-shaped segments facilitates interconnection of the overlapped portions of the Z-shaped segments by helical spring connectors 98, as discussed above.

Referring to FIG. 8, it will be noted that several rotations 100 of the helical lacing wire connector 98 pass around and lock adjacent overlapped segments 102 of the coils to coils or coil units of the adjacent rows. It will further be noted that the Z-shaped segments are all shaped and positioned so that the locked, overlapped segments 102 are all in a common transverse plane 104 which passes through the axes 106 of all the coils and coaxial coil units contained in a transverse column. Consequently, each coil or coaxial coil unit is connected to two other coils or coil units of adjacent rows by connectors 100 having centers 104 which are located is a diametrical plane of the coils and coil units as defined by the axes 106.

Referring now to FIG. 9, each block 110 represents the effective outline of a typical top plane Z-shaped interconnection segment 89. Similarly, each block 112 represents the outline of a typical top plane Z-shaped interconnection segment 93 in the row containing the coaxial coil units 92*a*, 92*b* of the invention. Each block 111 represents the outline of a typical bottom plane Z-shaped interconnection segment 91 and each block 113 represents the outline of a typical bottom plane Z-shaped interconnection segment 95. Thus, as apparent from the diagram in FIG. 9, the blocks 110, 112 and 111, 113 representing load supporting units. Each of these units 110, 112 and 111, 113 are overlapped such that the effect of the construction of the innerspring structure of FIG. 9 is a very densely packed innerspring assembly with a relatively high count of coils. Furthermore, the coil rows of FIG. 9 provide load bearing units which are firmer, stronger and more supportive according to the description of the invention.

Several different coil configurations have been illustrated for practicing the present invention; however, in addition to the individual coils and continuous coil products illustrated, other coil products might also be utilized. In accordance with the principles of the invention, Bonnell coils might be utilized, as well as knotted coils, e.g., offset coils, and unknotted coils.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. An innerspring structure for a mattress comprising:

a row of non-pocketed outer coils, the row being formed from a single continuous piece of wire and containing outer coils interconnected by interconnection segments;

a row of non-pocketed inner coils, the row being formed from a single continuous piece of wire and containing inner coils interconnected by interconnection segments;

the row of inner coils being positioned together with said row of outer coils and the inner coils being positioned generally coaxially with the outer coils to form reinforced coil units which extend between top and bottom face surfaces of the innerspring structure;

interconnection segments of each row being overlapped relative to one another proximate both of said top and bottom face surfaces;

unitary, helically-shaped wire connectors wrapped around and engaging overlapped interconnection segments of the rows in both the top and bottom face surfaces of the innerspring structure, and engaging both the row of inner coils and the row of outer coils to directly secure the rows of inner and outer coils together in an assembled relation to form the reinforced coil units in the innerspring structure, the reinforced coil units having generally equal firmness along their individual lengths for supporting the top and bottom face surfaces of the innerspring structure.

2. The innerspring structure of claim 1 further comprising a plurality of additional rows of coils, each row formed from a single continuous piece of wire, the rows assembled together with the reinforced coil units in the innerspring structure.

3. The innerspring structure of claim 2 wherein sections of an additional row are overlapped relative to sections of an adjacent additional row, the overlapped sections connected together by a connector to secure the rows of the coils in an assembled innerspring structure.

4. The innerspring structure of claim 1 wherein the helical wire spans generally completely across the rows of inner and outer coils to connect the rows together in an assembled relation along their length.

5. The innerspring structure of claim 1 wherein said interconnecting segments are generally Z-shaped.

6. The innerspring structure of claim 1 wherein the inner and outer coils forming the coaxial coil unit have approximately the same pitch.

7. The innerspring structure of claim 1 wherein the coils have a plurality of coil turns, the coil turns intermediate the interconnecting segments of the inner and outer coils forming the coaxial coil unit have approximately the same diameter.

8. The innerspring structure of claim 1 wherein the inner and outer coils forming the coaxial coil unit have the same turn direction.

9. A spring structure for use in an innerspring structure of a mattress comprising:

a row of non-pocketed outer coils, the row being formed from a single continuous piece of wire and containing outer coils interconnected by interconnection segments;

a row of non-pocketed inner coils, the row being formed from a single continuous piece of wire and containing inner coils interconnected by interconnection segments;

the row of inner coils being positioned together with said row of outer coils and the inner coils being positioned generally coaxially with the outer coils to form reinforced coil units which extend between top and bottom face surfaces of the spring structure;

interconnection segments of each row being overlapped relative to one another proximate both of said top and bottom face surfaces;

unitary, helically-shaped wire connectors wrapped around and engaging overlapped interconnection segments of the rows in both the top and bottom face surfaces of the spring structure and engaging both the row of inner coils and the row of outer coils to directly secure the rows of inner and outer coils together in an assembled relation to form the reinforced coil units, the reinforced coil units having generally equal firmness along their individual lengths for supporting the top and bottom face surfaces of the spring structure.

10. The spring structure of claim 9 wherein said interconnecting segments are generally Z-shaped.

11. The spring structure of claim 9 wherein the inner and outer coils forming the coaxial coil units have approximately the same pitch.

12. The spring structure of claim 9 wherein the coils have a plurality of coil turns, the coil turns intermediate the interconnecting segments of the inner and outer coils forming the coaxial coil units have approximately the same diameter.

13. The spring structure of claim 9 wherein the inner and outer coils forming the coaxial coil units have the same turn direction.

14. An innerspring structure for a mattress comprising:

a plurality of adjacent non-pocketed outer coils extending generally parallel to one another between bottom and top face surfaces of an innerspring structure:

a plurality of adjacent non-pocketed inner coils extending generally parallel to one another between the top and bottom face surfaces, the inner coils positioned generally coaxially with the outer coils, the inner and outer coils cooperatively forming reinforced coil units in the innerspring structure;

unitary helically-shaped wire connectors wrapped around and engaging both the inner and outer coils of the coaxial units proximate both of the top and bottom face surfaces to directly secure the inner and outer coils together as reinforced units in the innerspring structure;

the reinforced coaxial coil units providing generally equal firmness along their lengths in said innerspring structure for providing support at the top and bottom face surfaces of the innerspring structure.

15. The innerspring structure of claim 14 wherein the inner and outer coils have end turns positioned in one of the top and bottom face surfaces, the helically-shaped wire connectors simultaneously engaging the end turns of the respective inner and outer coils to secure the coils together in a unit.

16. The innerspring structure of claim 14 wherein said row of coaxial coil units are coupled to additional adjacent rows of coils by a helical wire coil for forming an innerspring structure.

17. A method of forming an innerspring structure for a mattress comprising:

providing a row of non-pocketed inner coils and a row of non-pocketed outer coils, each row of coils formed from a single continuous piece of wire and containing coils interconnected by interconnection segments;

positioning the row of inner coils together with said row of outer coil, the rows being positioned such that the inner coils are generally coaxial with the outer coils to form reinforced coil units which extend between top and bottom face surfaces of the innerspring structure;

overlapping interconnection segments of one row with corresponding interconnection segments of the other row in both the top and bottom face surfaces;

engaging and wrapping the overlapped segments of the rows with unitary, helically-shaped wire connectors in both the top and bottom face surfaces for engaging both the row of inner coils and the row of outer coils to directly secure the rows of inner and outer coils together in an assembled relation to form the reinforced coil units in the innerspring structure, the reinforced coil units having generally equal firmness along their individual lengths for supporting the top and bottom face surfaces of the innerspring structure.

18. The method of claim 17 further comprising positioning a plurality of additional coil rows proximate the reinforced coil unit for forming an innerspring structure, each row formed from a single continuous piece of wire.

19. A method of forming an innerspring structure for a mattress comprising:

providing a plurality of non-pocketed outer coils and a plurality of non-pocketed inner coils, the coils extending generally parallel to one another to define top and bottom face surfaces of an innerspring structure;

positioning the inner coils together with said outer coils such that the inner coils are generally coaxial with the outer coils for forming reinforced coil units in the innerspring structure which extend between the top and bottom face surfaces of the innerspring structure;

engaging and wrapping both the inner coils and the outer coils of the coaxial coil units with a unitary, helically-shaped wire connector in both the top and bottom face surfaces of the innerspring structure to directly secure the coils together as reinforced coil units in the innerspring structure, the reinforced coil units having generally equal firmness along individual lengthy for supporting the top and bottom face surfaces of the innerspring structure.

20. The method of claim 19 wherein the inner and outer coils have end turns positioned in one of the top and bottom face surfaces, the method further comprising simultaneously engaging the end turns of the respective inner and outer coils with the helically-shaped wire connectors to secure the coils together in said reinforced coil units.

21. The method of claim 19 wherein the helically-shaped wire connectors span generally completely across the rows of inner and outer coils to connect the rows together.

* * * * *

UNITED STATES PATENT AND TRADEMARK OFFICE

CERTIFICATE OF CORRECTION

PATENT NO. : 5,803,440

DATED : September 8, 1998

INVENTOR(S) : Thomas J. Wells

It is certified that error appears in the above-identified patent and that said Letters Patent is hereby corrected as shown below:

In claim 4, column 13, lines 66 and 67, delete "helical wire" and insert --helically shaped wire connectors--.

In claim 4, column 13, line 67, delete "spans" and insert --span--.

In claim 5, column 14, line 4, delete "interconnecting" and insert --interconnection.--

In claim 8, column 14, line 14, delete "unit" and insert --units--.

In claim 19, column 16, line 27, delete "along individual lengthy" and insert --along their individual lengths--.

Signed and Sealed this

Second Day of March, 1999

*Attest:*

Q. TODD DICKINSON

*Attesting Officer*

*Acting Commissioner of Patents and Trademarks*